United States Patent [19]

Day

[11] 3,978,769

[45] Sept. 7, 1976

[54] BUCKET POSITIONER KICKOUT SLAVE CYLINDER

[75] Inventor: Ralph R. Day, Aurora, Ill.

[73] Assignee: Caterpillar Tractor Co., Peoria, Ill.

[22] Filed: Mar. 11, 1976

[21] Appl. No.: 665,943

Related U.S. Application Data

[63] Continuation of Ser. No. 507,262, Sept. 19, 1974, abandoned.

[52] U.S. Cl. ..... 91/358 A; 91/388; 91/401

[51] Int. Cl.[2] ..... F15B 13/16; F15B 15/22

[58] Field of Search ..... 91/401, 358 A, 402, 91/388

[56] References Cited

UNITED STATES PATENTS

| | | | |
|---|---|---|---|
| 1,876,024 | 9/1932 | Rosenberry | 91/401 |
| 2,190,257 | 2/1940 | Clench | 91/401 |
| 3,153,965 | 10/1964 | Muhlbock | 91/401 |
| 3,511,133 | 5/1970 | Day | 91/388 |
| 3,714,866 | 2/1973 | Ottestod | 91/402 |
| 3,831,379 | 8/1974 | Lixenfeld | 91/401 |

*Primary Examiner*—Paul E. Maslousky
*Attorney, Agent, or Firm*—Wegner, Stellman, McCord, Wiles & Wood

[57] ABSTRACT

A combination slave cylinder and relief valve for controlling release of a valve lever from a detented position. The valve is operated by pressurized fluid and is arranged to relieve the fluid pressure at a preselected value above that required for release of the lever.

4 Claims, 2 Drawing Figures

32
31
30
33
40
38
11
23
18
10
62
13
39
34
35
37
43
42
22
44
41
20
29
36
45
21
19
17
12
14
26
16
25
27
15
P
V
REL
24
28
65

58
10
48
46
47
54
57
49
39
51
61
62
53
55
60
63
50
64
52
56
59

BUCKET POSITIONER KICKOUT SLAVE CYLINDER

This is a continuation of application Ser. No. 507,262 filed Sept. 19, 1974 now abandoned.

BACKGROUND OF THE INVENTION

1. Field of the Invention

This invention relates to fluid operated devices and in particular to operator devices for operating associated mechanical apparatus.

2. Description of the Prior Art

In U.S. Pat. No. 3,511,133 of applicant, owned by the assignee hereof, a position control for hydraulic jacks is disclosed having a slave cylinder and piston apparatus for operating a bell crank member controlling movement of a detent mechanism lever. An adjustable volume accumulator is provided which regulates the fluid volume delivered to the slave cylinder and concurrently regulates the pressure thereof. The apparatus further includes a pressure relief check valve which relieves excessive pressure in the supply to the slave cylinder. The volume accumulator and pressure regulator includes a piston biased by a spring against the fluid pressure. As the pressure increases, the piston moves downwardly against the biasing action which may be adjusted by means of a screw to permit the slave cylinder piston to operate the bell crank and detent lever when the pressure of the fluid delivered thereto reaches a preselected operating pressure.

SUMMARY OF THE INVENTION

The present invention comprehends a further improved position control of the type disclosed in said U.S. Pat. No. 3,511,133 and more specifically, comprehends the provision of a combination slave cylinder and relief valve providing improved functioning of the apparatus.

In lieu of the use of the external relief valve mounted on the hydraulic cylinder in said patent, the present invention comprehends providing, in the slave cylinder and piston structure, means for relieving the fluid pressure by discharging the fluid from the cylinder when the piston moves to a preselected limit position beyond that required for operation of the detent mechanism. The slave cylinder and piston effectively define an operator which is mounted in the fluid tank so as to be environmentally protected and facilitate return of the relieved fluid to the pressurized fluid supply means.

In the illustrated embodiment, the piston is provided with a through passage which is normally closed by a cylinder wall portion until the piston reaches the limit position, whereupon the passage conducts pressurized fluid from the slave cylinder chamber outwardly therefrom to relieve the pressure.

The pressure relief effected in the operator is set to occur at a value higher than the regulated pressure provided by the accumulator-pressure regulator. The latter pressure is preselected to provide the desired operation of the detent mechanism. The detent mechanism may be provided for controlling a hydraulic jack such as used in tilting or lifting buckets and similar implements on earthmoving machinery. The detent mechanism permits the operator to set the control valve and perform other functions during operation of the jack. The operation of the detent mechanism releases the control and permits it to return to a neutral position upon desired positioning of the implement by the jack. The present invention provides an improved simplified structure for controlling such a detent mechanism.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
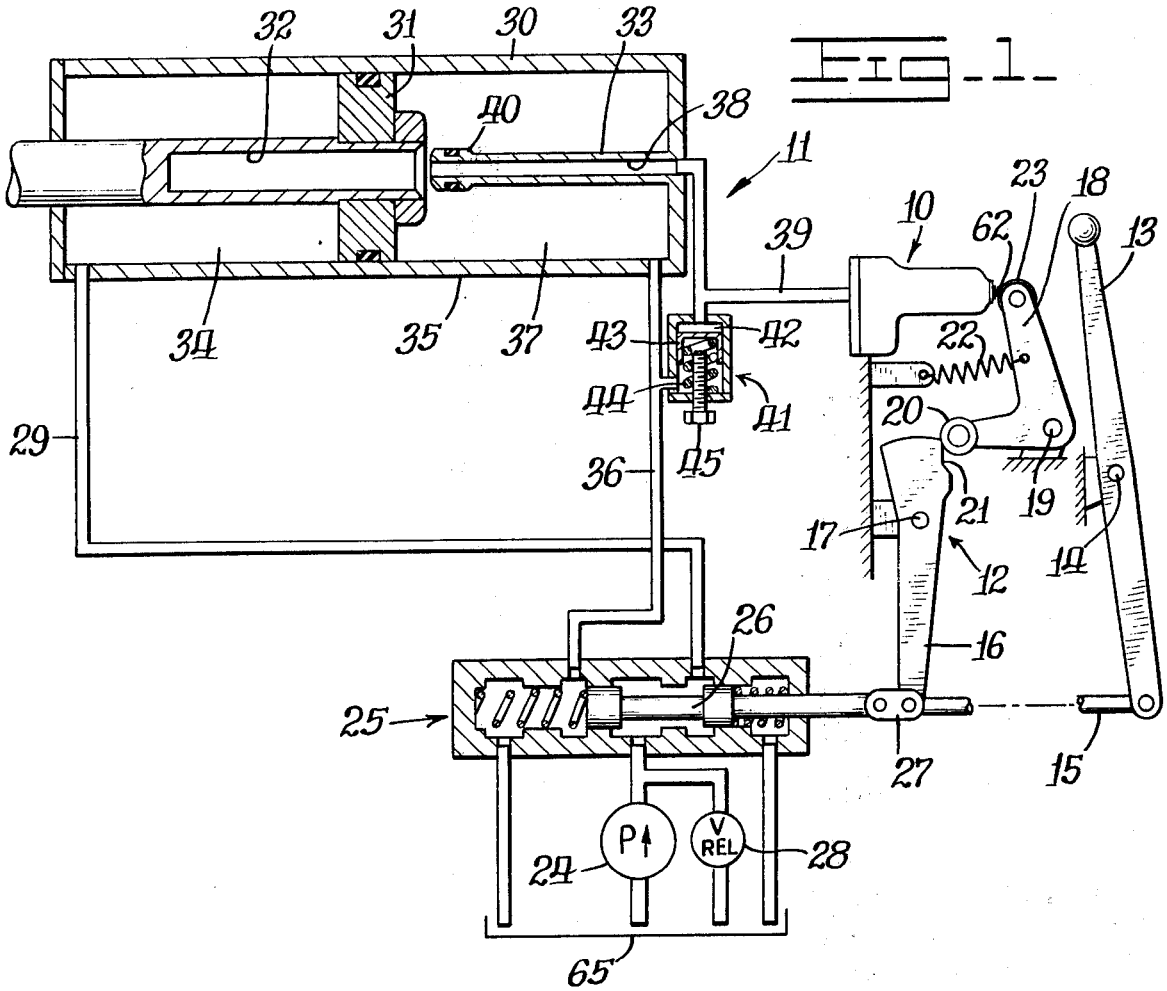
FIG. 1 is a schematic hydraulic circuit diagram of an apparatus embodying the invention.

In the exemplary embodiment of the invention as disclosed in the drawing, an improved operator 10 is provided in a hydraulic apparatus generally designated 11 for controlling a detent mechanism generally designated 12. The detent mechanism controls an operating lever 13 which is pivotally mounted on a pivot 14 and connected by a link 15 to an arm 16 of detent mechanism 12 pivotally mounted on a pivot 17. In the position of FIG. 1, lever 13 is disposed in a rackback position and maintained therein by a locked condition of the detent mechanism arm 16. More specifically, the detent mechanism includes a bell crank 18 pivotally mounted on a pivot 19 and having a roller 20 adapted to engage an interlocking surface 21 on arm 16 in the detent position. Crank arm 18 is biased to the detent arrangement by a suitable spring 22 which, as shown in FIG. 1, biases the crank arm in a counterclockwise direction about pivot 19 to engage a second roller 23 with the operator 10.

Release of the detent mechanism from the detent arrangement of FIG. 1 by moving the roller 20 upwardly from engagement with arm portion 21 and thereby automatically release lever 13 from the rackback position is effected herein by suitable movement of the crank arm by the operator 10 as a result of a fluid pressure operation.

More specifically, pressurized fluid is delivered from a pump 24 through a control valve 25 having a movable spool 26 connected to the link 15 and arm 16 by suitable connector 27. A pressure relief valve 28 may be provided in association with pump 24 to provide a regulated fluid pressure in supply line 29 communicating between control valve 25 and a hydraulic motor 30.

The hydraulic motor includes a piston 31 having an axial, outwardly opening recess 32 adapted to receive a probe 33 as the piston moves forwardly, or to the right, as seen in FIG. 1, in the operation of the hydraulic motor. In effecting such movement, the pressurized fluid is delivered to the lefthand chamber 34 in the cylinder 35 of the hydraulic motor and fluid is returned to the tank 65 through a return line 36 communicating with the righthand chamber 37 of the cylinder 35.

Probe 33 defines an axial passage 38 which delivers fluid from recess 32 to a transfer line 39 connected to operator 10. Such fluid is delivered therethrough as a result of an enlarged head portion 40 at the distal end of the probe entering the recess 32 in peripherally sealed association with the piston whereby fluid trapped in recess 32 is forced through passage 38 and line 39 by the continued forward, or rightward, movement of the piston, as seen in FIG. 1.

The pressure of the fluid in line 39 is regulated by a volume accumulator and pressure regulating device 41 defining a pressure chamber 42 communicating with line 39. Device 41 includes a piston 43 biased against the pressure in chamber 42 by a suitable spring 44 so as to permit chamber 42 to have a variable volume determined by the resultant pressure acting on piston 43. A screw 45 is provided for limiting the movement of piston 43. The back side of the piston is in communication with the supply line 36 to provide a balanced operation of the device 41.

Figure 2:
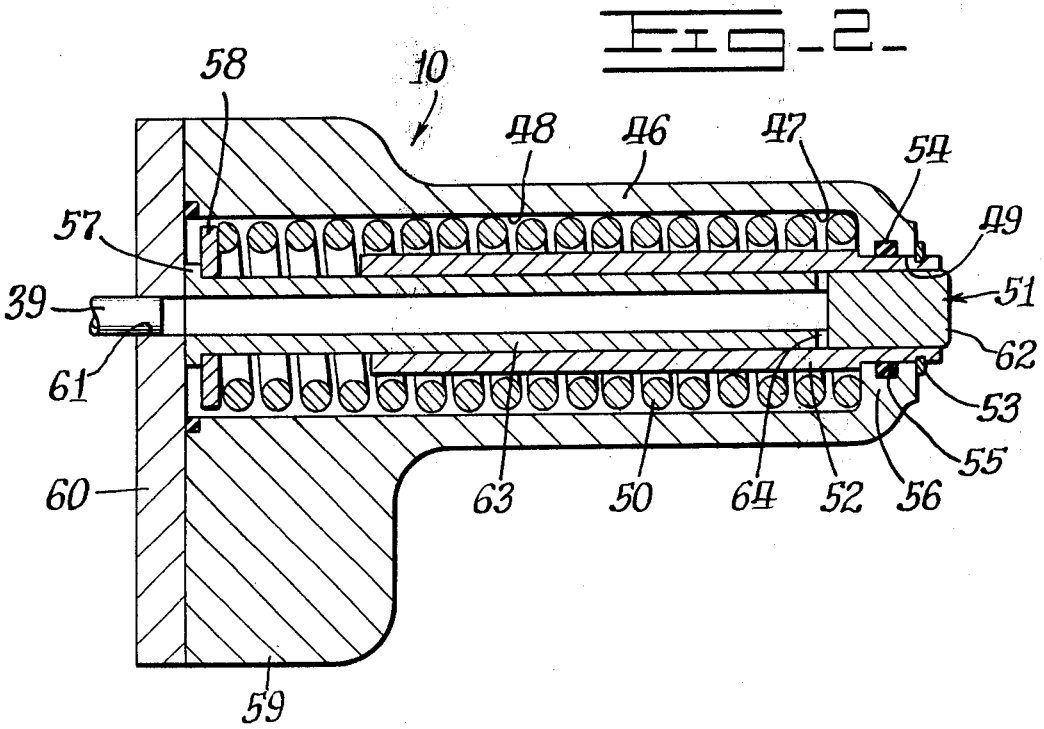
FIG. 2 is a fragmentary enlarged vertical section of the improved operator.

The construction of operator 10 is best seen by reference to FIG. 2. More specifically, operator 10 includes an elongated housing 46 defining a through bore 47 having an enlarged end 48 and a reduced end 49. A coil spring 50 is coaxially disposed in bore portion 49 for biasing a piston 51 coaxially therein. Housing 46 carries a tubular wall 52 slidably receiving piston 51. Wall 52 may be secured to the housing by a suitable ring 53 and sealed thereto by a suitable O-ring 54 in a recess 55 in an inturned end portion 56 defining the reduced bore portion 49. Piston 51 projects rearwardly from tubular wall 52 and is provided at its rear end with an outturned flange 57 against which is seated an annular collar 58. Spring 50 is compressed between housing portion 56 and collar 58 to provide a preselected biasing of the piston. Rearward end 59 of the housing is closed by a plate 60 having a small bore 61 receiving the end of the transfer line 39.

Piston 51 includes a head portion 62 and a tubular rear portion 63 opening to closure plate bore 61 for receiving pressurized fluid from the transfer line 39 and thereby urging the head portion 62 outwardly from tubular wall 52 against the biasing action of spring 50. Lateral passages 64 are provided in tubular portion 63 adjacent 62. With any portion of head 62 retained within the tubular wall, lateral passages 64 are closed and the full fluid pressure is directed against the piston tending to urge it outwardly against the roller 23 and thereby tend to swing rocker arm 18 in a clockwise direction about pivot 19 against the biasing action of spring 22. The movement of the piston is a function of the fluid pressure and the strength of spring 50. The fluid pressure, as indicated above, may be adjusted by suitable adjustment of pressure regulator 41 so that coordination between the developed fluid pressure and the movement of piston 62 may be effected to provide a release of the latching mechanism when the fluid pressure reaches a preselected release pressure. As indicated above, the pressure increases as the piston 31 in motor 30 moves to the right and, thus, at some preselected position of the piston 31, piston 51 is moved sufficiently to trip the detent mechanism 12 and thereby release lever 13 for repositioning by the spool valve 26. Thus, the release of lever 13 is accurately coordinated with the positioning of piston 31 to provide a desired automatic control thereof.

If for any reason the fluid pressure in transfer line 39 becomes excessive, the overpressure is immediately relieved by the movement of the piston 51 sufficiently outwardly against the action of spring 50 to expose radial passages 64 outwardly of the tubular wall 52. As operator 10 is provided within the fluid supply tank, return of the overpressure fluid to the sump 65 for recirculation by pump 24 may be effected without the need for return lines.

Thus, the operator 10 provides for improved operation of the detent mechanism in providing limited movement of piston 62 and automatic limitation on the fluid pressure. Up to the relief pressure, the regulator 41 may be utilized to adjust the system to assure proper operation of the detent mechanism for a given movement of the piston 31. Thus, apparatus 10 provides a simple low cost, substantially foolproof automatic detent mechanism control.

The foregoing disclosure of specific embodiments is illustrative of the broad inventive concepts comprehended by the invention.

I claim:

1. In a position control apparatus, a detent mechanism, spring means for biasing said detent mechanism, operator means responsive to fluid pressure to move to an operating position preselected to cause operation of the detent mechanism, and regulator means for limiting the fluid pressure to a preselected operating pressure at least equal to that required for operation of the detent mechanism by the operator means, the improvement comprising means for limiting movement of the operator means beyond said operating position to an accurately preselected limit position, said movement limiting means comprising means for discharging pressurized fluid from the operator means to limit the fluid pressure therein to a preselected maximum pressure greater than said operating pressure when the operator means is at said preselected limit position, said operator means comprising means defining a pressure chamber, a piston movable in said chamber, means defining an inlet to said chamber for delivering the pressurized fluid thereto for moving said piston, and spring means in said chamber biasing the piston against movement by the pressurized fluid, and said movement limiting means comprising outlet means for discharging pressurized fluid from said chamber when said piston moves to the preselected limit position, said outlet means including a passage through said piston and means forming a portion of said chamber means for maintaining said passage closed until the piston reaches said limit position.

2. The position control apparatus of claim 1 wherein said chamber spring means concentrically surrounds said piston.

3. The position control apparatus of claim 1 wherein said piston is provided with means engageable with said chamber defining means for limiting movement of the piston.

4. The position control apparatus of claim 1 wherein said piston is provided with a collar for engagement by said spring means and said chamber defining means includes a tubular wall engageable by said collar for limiting movement of the piston.

* * * * *